US007905163B1

(12) United States Patent
Chiang

(10) Patent No.: US 7,905,163 B1
(45) Date of Patent: Mar. 15, 2011

(54) TOOL COMBINATION

(75) Inventor: Wen Hung Chiang, Taichung Hsien (TW)

(73) Assignee: Hsin ying Enterprise Co., Ltd., Wantien Tsuen, Dadu Hsiang Taichung Hsien (TW)

( * ) Notice: Subject to any disclaimer, the term of this patent is extended or adjusted under 35 U.S.C. 154(b) by 0 days.

(21) Appl. No.: 12/218,304

(22) Filed: Jul. 14, 2008

(51) Int. Cl.
*B25B 23/16* (2006.01)
*B25G 1/04* (2006.01)

(52) U.S. Cl. ..... 81/177.9; 81/177.7; 81/177.85

(58) Field of Classification Search ..... 81/177.6–177.8, 81/177.85, 177.9
See application file for complete search history.

(56) References Cited

U.S. PATENT DOCUMENTS

| | | | | |
|---|---|---|---|---|
| 3,779,107 | A | 12/1973 | Avery | 81/177.8 |
| 4,711,145 | A | 12/1987 | Inoue | 81/177.1 |
| 5,236,289 | A | 8/1993 | Salyer | 408/127 |
| 5,280,740 | A | 1/1994 | Ernst | 81/177.7 |
| 5,515,754 | A * | 5/1996 | Elkins | 81/177.9 |
| 5,737,982 | A * | 4/1998 | Lin | 81/58.3 |
| 6,105,473 | A | 8/2000 | Huang | 81/177.75 |
| 6,167,787 | B1 | 1/2001 | Jarvis | 81/177.2 |
| 6,260,452 | B1 * | 7/2001 | Yu | 81/177.2 |
| 6,412,373 | B1 * | 7/2002 | Hsiao | 81/177.7 |
| 6,976,411 | B1 * | 12/2005 | Yu | 81/177.2 |
| 7,278,342 | B1 * | 10/2007 | Chang | 81/177.75 |
| 7,363,839 | B2 * | 4/2008 | Chiang | 81/177.75 |
| 7,387,053 | B2 * | 6/2008 | Lee | 81/177.1 |
| 7,392,727 | B1 * | 7/2008 | Chiang | 81/124.4 |
| 7,481,136 | B2 * | 1/2009 | Chiang | 81/177.75 |
| 2007/0214916 | A1 * | 9/2007 | Lee | 81/177.1 |

* cited by examiner

*Primary Examiner* — David B Thomas
(74) *Attorney, Agent, or Firm* — Charles E. Baxley

(57) ABSTRACT

A tool combination includes a shaft having a non-circular segment, a tool carrying head having a stud pivotally mounted to the shaft, and a sleeve slidably engaging onto the shaft and having a compartment formed in one end for receiving the end portion of the shaft and the stud of the tool carrying head and for retaining the stud of the tool carrying head in line with the shaft, and one end of the shaft is engageable with a power driving tool for being driven by the power driving tool automatically, and the non-circular segment of the shaft is engageable with a non-circular space of the sleeve for allowing the shaft to be selectively rotated by the sleeve manually.

15 Claims, 6 Drawing Sheets

TOOL COMBINATION

BACKGROUND OF THE INVENTION

1. Field of the Invention

The present invention relates to a tool combination, and more particularly to a tool combination including a pivotal head selectively rotatable or drivable with a power driving tool or rotatable or drivable manually.

2. Description of the Prior Art

Typical ratchet wrench tools comprise a ratchet tool head rotatably or pivotally mounted or attached to a handle or tool holder and rotatable relative to the handle or tool holder to any selected angular positions.

For example, U.S. Pat. No. 3,779,107 to Avery discloses one of the typical ratchet wrench tool head positioners comprising a ratchet tool head including a number of spaced transverse grooves formed therein for rotatably or pivotally attaching to a tool holder in selected positions.

However, the typical ratchet wrench tool head may only be rotated or driven manually, but may not be rotated or driven by the power driving tools.

U.S. Pat. No. 4,711,145 to Inoue discloses another typical ratchet handle comprising a handle angularly adjusted relative to the tool carrying head, and a complicated moving part provided to engage with the tool carrying head and to lock the handle and the head in the desired angular relationship.

However, similarly, the typical ratchet handle may only be rotated or driven manually, but may not be rotated or driven by the power driving tools.

U.S. Pat. No. 5,236,289 to Salyer discloses a typical shielded universal joint having a pivot head defining a primary axis, and having a pin defines a first pivot axis extending longitudinally through the pin, and the pin and a throat define a second pivot axis extending through the throat and the pin perpendicular to the first pivot axis.

However, similarly, the typical shielded universal joint also may only be rotated or driven manually, but may not be rotated or driven by the power driving tools.

U.S. Pat. No. 5,280,740 to Ernst discloses a further typical flexible head socket wrench comprising a socket driver head pinned to a clevis on a shaft and arranged for allowing the socket driver head to be rotated or pivoted relative to the shaft to any selected angular positions.

However, similarly, the typical ratchet handle may only be rotated or driven manually, but may not be rotated or driven by the power driving tools.

U.S. Pat. No. 6,105,473 to Huang discloses a still further typical rotatable tool driving head comprising a lock device for selectively locking the driving head to a tool member and for preventing the driving head from rotating relative to the tool member about a pivotal coupler.

However, similarly, the typical rotatable tool driving head may only be rotated or driven manually, but may not be rotated or driven by the power driving tools.

U.S. Pat. No. 6,167,787 to Jarvis discloses a still further typical locking swivel wrench comprising a jointed drive head situated in a series of angular positions relative to a handle, and a holding device for temporarily holding the driving head at a predetermined angle with respect to the handle.

However, similarly, the typical rotatable tool driving head may only be rotated or driven manually, but may not be rotated or driven by the power driving tools.

The present invention has arisen to mitigate and/or obviate the afore-described disadvantages of the conventional ratchet wrench tools or tool combinations.

SUMMARY OF THE INVENTION

The primary objective of the present invention is to provide a tool combination including a pivotal head selectively rotatable or drivable with a power driving tool or selectively rotatable or drivable manually.

In accordance with one aspect of the invention, there is provided a tool combination comprising a shaft including a first end portion, and including a second end portion, and the shaft including a non-circular segment formed therein, a tool carrying head including a stud pivotally mounted to the second end portion of the shaft, and a sleeve slidably and rotatably and selectively engaging onto the shaft, and including a first end portion having a compartment formed therein for slidably and rotatably receiving the second end portion of the shaft and the stud of the tool carrying head and for retaining the stud of the tool carrying head in line with the shaft, and the sleeve including a second end portion, and the sleeve including a non-circular space formed therein, the first end portion of the shaft is engageable with a power driving tool for being selectively rotated and driven by the power driving tool, and the non-circular segment of the shaft is engageable with the non-circular space of the sleeve for allowing the shaft to be selectively rotated and driven by the sleeve, and shaft is rotatable relative to the sleeve when the non-circular segment of the shaft is disengaged from the non-circular space of the sleeve.

The shaft includes at least one peripheral recess formed therein, and the sleeve includes a detent slidably attached to the sleeve for selectively engaging with the peripheral recess of the shaft and for securing the sleeve to the shaft at a selected position.

A control ferrule is further provided and attached onto the sleeve and engageable with the detent for forcing the detent to engage with the peripheral recess of the shaft.

The sleeve includes a retaining ring attached thereon, and the control ferrule includes at least one ratchet groove formed therein for selectively engaging with the retaining ring and for anchoring the control ferrule to the sleeve.

The shaft includes a retaining ring attached thereon, and the sleeve includes at least one ratchet groove formed therein for selectively engaging with the retaining ring and for anchoring the sleeve to the shaft.

The tool carrying head includes a number of depressions formed in the stud, and the shaft includes a detent slidably attached to the shaft for selectively engaging with either of the depressions of the stud of the tool carrying head.

The shaft includes a latch slidably attached to the shaft for selectively engaging with the detent and for forcing the detent to engage with either of the depressions of the stud of the tool carrying head.

The latch includes a recess formed therein for selectively receiving the detent and for allowing the detent to be disengaged from the stud of the tool carrying head.

The tool carrying head includes a driving shank provided thereon, and the driving shank is coupled to the stud of the tool carrying head with a ratchet device.

The shaft includes a spring-biased projection engaged in the non-circular segment of the shaft for engaging with the non-circular space of the sleeve.

The shaft includes a non-circular stem provided on the first end portion of the shaft and extendible out of the sleeve and engageable with the power driving tool. The sleeve includes a hand grip provided on the second end portion of the sleeve for being grasped and held by a user.

The sleeve includes an enlarged space formed in the second end portion of the sleeve for selectively receiving and engaging with the non-circular segment of the shaft. The sleeve includes a lid attached to the second end portion of the sleeve for partially blocking the enlarged space of the sleeve.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
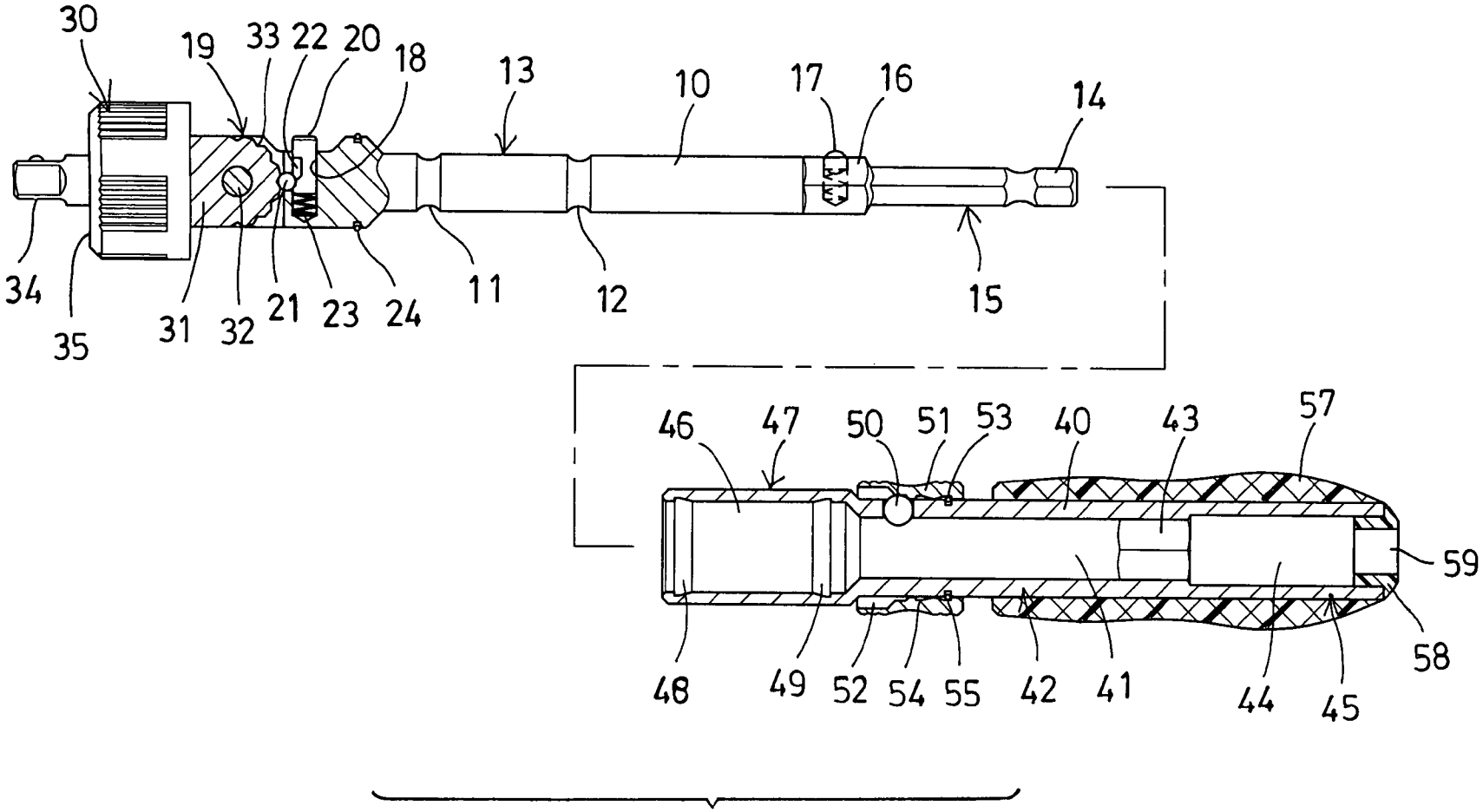
FIG. 1 is a partial exploded and partial cross sectional view of a tool combination in accordance with the present invention.
Figure 2:
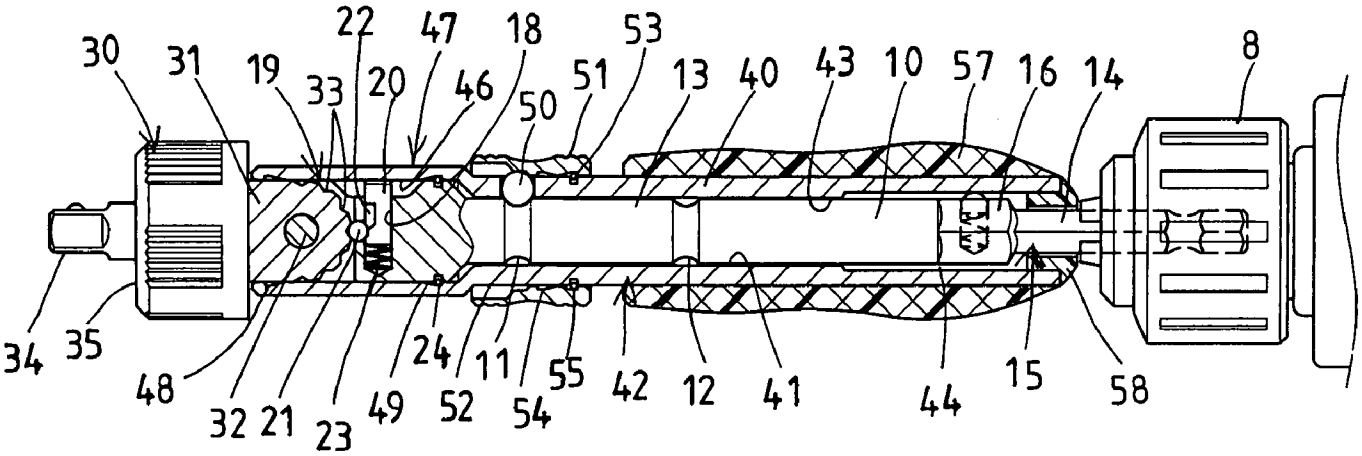
FIG. 2 is a partial cross sectional view of the tool combination.

Referring to the drawings, and initially to FIGS. 1 and 2, a tool combination in accordance with the present invention comprises a shaft 10 including one or more (such as two) peripheral recesses 11, 12 formed in the middle portion 13 thereof, and including a non-circular stem 14 formed or provided on one end portion 15 thereof, and including another non-circular segment 16 also formed or provided on the one end portion 15 thereof and located or arranged between the middle portion 13 thereof and the non-circular stem 14, and including a spring-biased projection 17 engaged in the non-circular segment 16 of the shaft 10, and including a cavity 18 laterally formed or provided in the other end portion 19 thereof for slidably receiving a latch 20.

Figure 3:
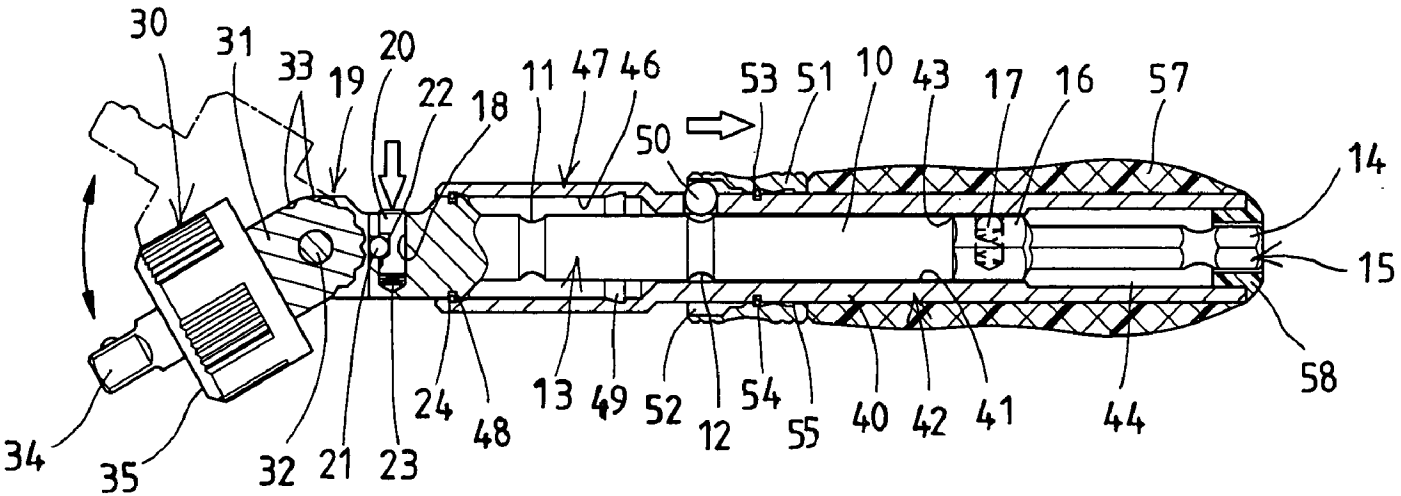
FIG. 3 is another partial cross sectional view similar to FIG. 2, illustrating the operation of the tool combination.

A tool carrying head 30 includes one end or a stud 31 rotatably or pivotally mounted or attached to the other end portion 19 of the shaft 10 with a pivot axle 32, and includes a number of depressions 33 formed in the outer peripheral portion of the stud 31 and facing toward the shaft 10 and the latch 20, and includes a driving shank 34 formed or attached or provided thereon directly or in directly with a ratchet device 35 for allowing the driving shank 34 or the tool carrying head 30 to be rotated or driven by the shaft 10 in either direction. The ratchet device 35 is typical and will not be described in further details. The driving shank 34 may be provided for engaging with tool shanks, tool extensions or the other tool members (not shown), and the latch 20 is provided for latching or securing the tool carrying head 30 to the shaft 10 at selected angular positions (FIG. 3).

For example, a detent 21 is slidably attached to the other end portion 19 of the shaft 10 for selectively engaging with either of the depressions 33 of the tool carrying head 30 and thus for latching or securing the tool carrying head 30 to the shaft 10 at selected angular positions. The latch 20 is engageable with the detent 21 for forcing the detent 21 to engage with either of the depressions 33 of the tool carrying head 30 (FIGS. 1, 2) and to latch or secure the tool carrying head 30 to the shaft 10 at the required or selected angular positions, and the latch 20 includes a recess 22 formed therein for selectively receiving the detent 21 (FIG. 3) and for allowing the detent 21 to be disengaged from the stud 31 of the tool carrying head 30 and thus for allowing the tool carrying head 30 to be freely rotated relative to the shaft 10.

A spring biasing means or member 23 is also received or engaged in the cavity 18 of the shaft 10, and engaged with the latch 20 for forcing or disengaging the recess 22 of the latch 20 from the detent 21 (FIGS. 1, 2) and for allowing the latch 20 to force the detent 21 to engage with either of the depressions 33 of the tool carrying head 30. The latch 20 may be depressed or actuated by the user against or onto the spring biasing member 23 to align the recess 22 of the latch 20 with the detent 21 and to selectively receive the detent 21 and to allow the tool carrying head 30 to be freely rotated relative to the shaft 10 to the required or selected angular positions before the detent 21 is forced to engage with either of the depressions 33 of the tool carrying head 30 again. A retaining ring 24 is attached onto the other end portion 19 of the shaft 10.

A sleeve 40 includes a bore 41 formed therein, such as formed in the middle portion 42 thereof for slidably and rotatably receiving the middle portion 13 of the shaft 10 and for slidably and rotatably engaging onto the shaft 10, and includes a non-circular space 43 formed in one end or in the middle portion 42 of the sleeve 40 for selectively receiving or engaging with the non-circular segment 16 of the shaft 10 (FIG. 3) and for allowing the shaft 10 to be selectively rotated or driven by the sleeve 40, and includes an enlarged space 44 formed in one end portion 45 thereof and having an inner diameter greater than the outer diameter of the non-circular segment 16 of the shaft 10 and for allowing the shaft 10 to be freely rotated relative to the sleeve 40 when the non-circular segment 16 of the shaft 10 is received or engaged in the enlarged space 44 of the sleeve 40 (FIG. 2).

The sleeve 40 includes an enlarged compartment 46 formed or provided in the other end portion 47 thereof for slidably and rotatably receiving the other end portion 19 of the shaft 10 (FIG. 3) and/or the stud 31 of the tool carrying head 30 (FIG. 2) and for retaining the stud 31 of the tool carrying head 30 in line with the shaft 10, and includes one or more (such as two) ratchet grooves 48, 49 formed or provided in the other end portion 47 thereof and communicating with the enlarged compartment 46 of the sleeve 40 for selectively receiving or engaging with the retaining ring 24 (FIGS. 2, 3) which may anchor or position the sleeve 40 to the shaft 10 at the required or selected positions. Another detent 50 is further provided and slidably attached to the sleeve 40 for selectively engaging with either of the peripheral recesses 11, 12 of the shaft 10 (FIGS. 2, 3) and for solidly securing the sleeve 40 to the shaft 10 at the required or selected positions.

A control ferrule 51 is slidably and rotatably attached onto the middle portion 42 of the sleeve 40 and engageable with the detent 50 for forcing the detent 50 to engage with either of the peripheral recesses 11, 12 of the shaft 10 (FIG. 2) and to solidly latch or secure the sleeve 40 to the shaft 10 at the required or selected positions, and the control ferrule 51 includes a recess 52 formed therein for selectively receiving the detent 50 (FIG. 3) and for allowing the detent 50 to be disengaged from the shaft 10 and thus for allowing the sleeve 40 to be moved relative to the shaft 10. A retaining ring 53 is attached onto the middle portion 42 of the sleeve 40, and the control ferrule 51 includes one or more (such as two) ratchet grooves 54, 55 formed or provided therein for selectively receiving or engaging with the retaining ring 53.

For example, the retaining ring 53 may be engaged with one of the ratchet grooves 54 of the control ferrule 51 (FIG. 3) for anchoring or positioning the control ferrule 51 to the sleeve 40 when the detent 50 is engaged in the recess 52 of the control ferrule 51, and the retaining ring 53 may be engaged with the other ratchet groove 55 of the control ferrule 51 (FIG. 2) for anchoring or positioning the control ferrule 51 to the sleeve 40 when the detent 50 is disengaged from the recess 52 of the control ferrule 51 and when the detent 50 is forced to engage with either of the peripheral recesses 11, 12 of the shaft 10 and to solidly latch or secure the sleeve 40 to the shaft 10 at the required or selected positions, and thus to prevent the sleeve 40 from further sliding relative to the shaft 10.

In operation, as shown in FIG. 2, when the sleeve 40 is moved forwardly relative to the shaft 10 to have both the other end portion 19 of the shaft 10 and the stud 31 of the tool carrying head 30 received or engaged in the enlarged compartment 46 of the sleeve 40, the detent 50 may be aligned with and engaged with the forward or front peripheral recess 11 of the shaft 10, and the control ferrule 51 may be moved relative to the shaft 10 to force the detent 50 to engage with the peripheral recess 11 of the shaft 10 and to solidly latch or secure the sleeve 40 to the shaft 10 at the required or selected position. At this moment, the non-circular stem 14 is extendible out of the sleeve 40 and engageable with the power driving tool 8 for being rotated or driven by the power driving tool 8.

Alternatively, as shown in FIG. 3, when the sleeve 40 is moved rearwardly relative to the shaft 10 to have the stud 31 of the tool carrying head 30 disengaged from the sleeve 40, the tool carrying head 30 may be rotated or adjusted relative to the shaft 10 to any required or selected position, and the latch 20 may selectively force the detent 21 to engage with either of the depressions 33 of the tool carrying head 30 and to latch or secure the tool carrying head 30 to the shaft 10 at the required or selected angular positions. At this moment, the detent 50 may be engaged with the rear peripheral recess 12 of the shaft 10 in order to latch or secure the sleeve 40 to the shaft 10 at the required or selected position, and the non-circular segment 16 of the shaft 10 may be engaged with the non-circular space 43 of the sleeve 40 for allowing the shaft 10 to be selectively rotated or driven by the sleeve 40 manually.

A hand grip 57 made of soft or resilient materials, such as rubber, plastic or other synthetic materials may be formed or provided or molded onto the one end portion 45 of the sleeve 40 for being softly or comfortably grasped or held by the user, and a lid 58 may also be made of soft or resilient materials, such as rubber, plastic or other synthetic materials, and may be attached or engaged into the one end portion 45 of the sleeve 40 for partially blocking the enlarged space 44 of the sleeve 40, and may include a bore 59 formed therein for slidably and stably receiving the non-circular stem 14 of the shaft 10 and for allowing the non-circular stem 14 of the shaft 10 to be selectively extended out of the sleeve 40 and to be selectively rotated or driven by the power driving tool 8, and also for preventing the non-circular stem 14 of the shaft 10 from vibrating relative to the sleeve 40.

As shown in FIG. 3, when the non-circular segment 16 of the shaft 10 is engaged with the non-circular space 43 of the sleeve 40, the spring-biased projection 17 may also be engaged with the non-circular space 43 of the sleeve 40 for anchoring or positioning the shaft 10 to the sleeve 40, and the spring-biased projection 17 may also be engaged with the inner peripheral surface of the sleeve 40 when the non-circular segment 16 of the shaft 10 is engaged with the enlarged space 44 of the sleeve 40 for stably receiving the non-circular segment 16 of the shaft 10 in the enlarged space 44 of the sleeve 40 and for preventing the non-circular segment 16 of the shaft 10 from vibrating relative to the sleeve 40.

Figure 4:
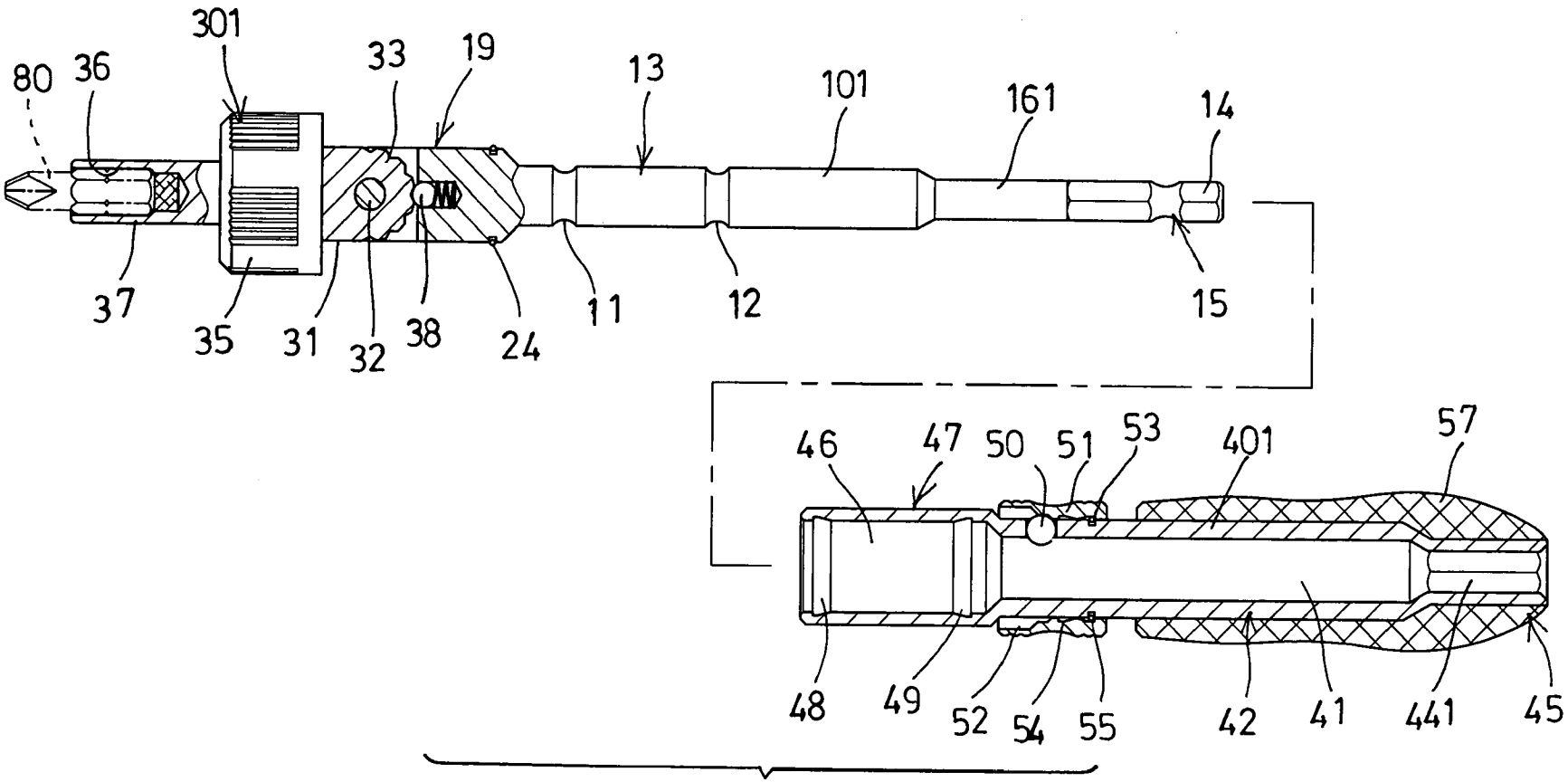
FIG. 4 is another partial exploded and partial cross sectional view similar to FIG. 1, illustrating the other arrangement of the tool combination.
Figure 5:
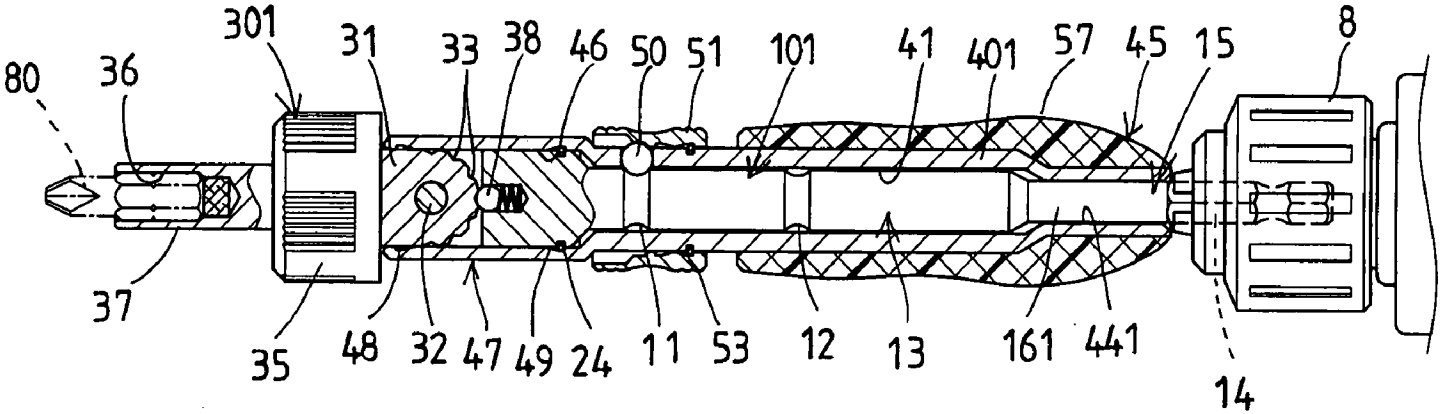
FIGS. 5, 6 are partial cross sectional views illustrating the operation of the tool combination as shown in FIG. 4.
Figure 6:
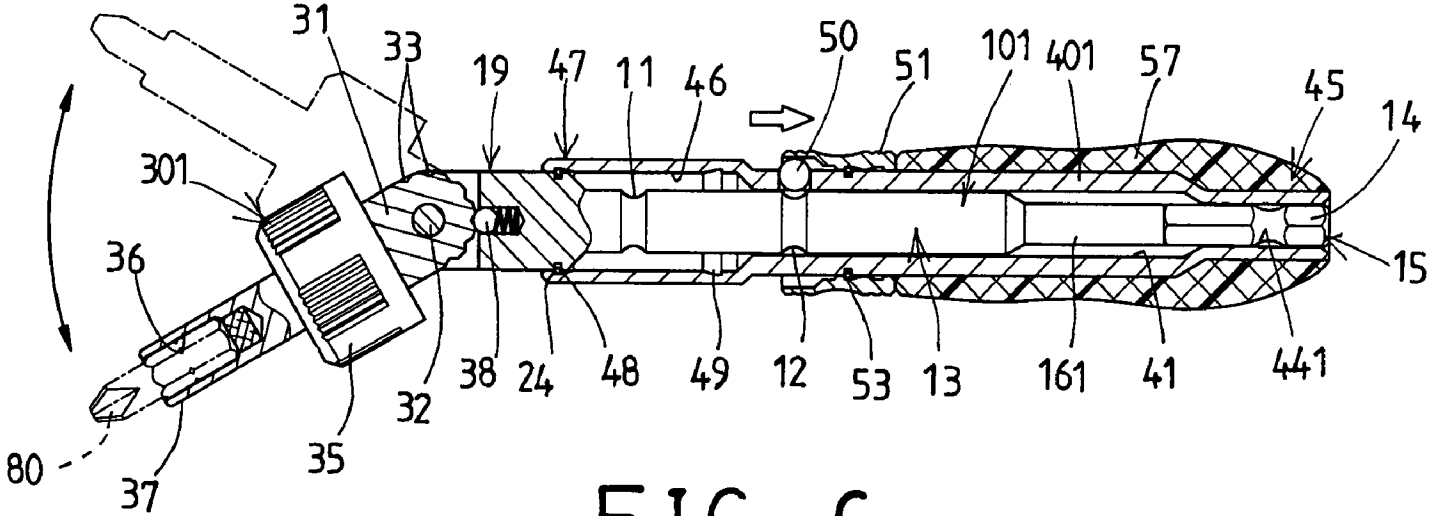

Alternatively, as shown in FIGS. 4-6, the tool carrying head 301 may include an engaging hole 36 formed in the driving shank 37 for engaging with a driven tool member 80, such as the screwdriver bit 80 and for allowing the driven tool member 80 to be rotated or driven by the driving shank 37 of the tool carrying head 301 and the shaft 101. A spring-biased projection 38 may be engaged in the other end portion 19 of the shaft 101 for engaging with either of the depressions 33 of the tool carrying head 301 and thus for latching or securing the tool carrying head 301 to the shaft 101 at selected angular positions. The shaft 101 includes a circular segment 161 formed or provided on the one end portion 15 thereof and located or arranged between the middle portion 13 thereof and the non-circular stem 14.

The sleeve 401 includes a non-circular orifice 441 formed in one end portion 45 thereof for selectively engaging with the non-circular stem 14 of the shaft 101 (FIG. 6) and for allowing the shaft 101 to be selectively rotated or driven by the sleeve 401 manually. Alternatively, the non-circular stem 14 may also be extended out of the sleeve 401 and engageable with the power driving tool 8 for being selectively rotated or driven by the power driving tool 8. At this moment, the circular segment 161 of the shaft 101 is rotatably engaged or received in the non-circular orifice 441 of the sleeve 401 for allowing the shaft 101 to be freely rotated relative to the sleeve 401 by the power driving tool 8.

Figure 7:
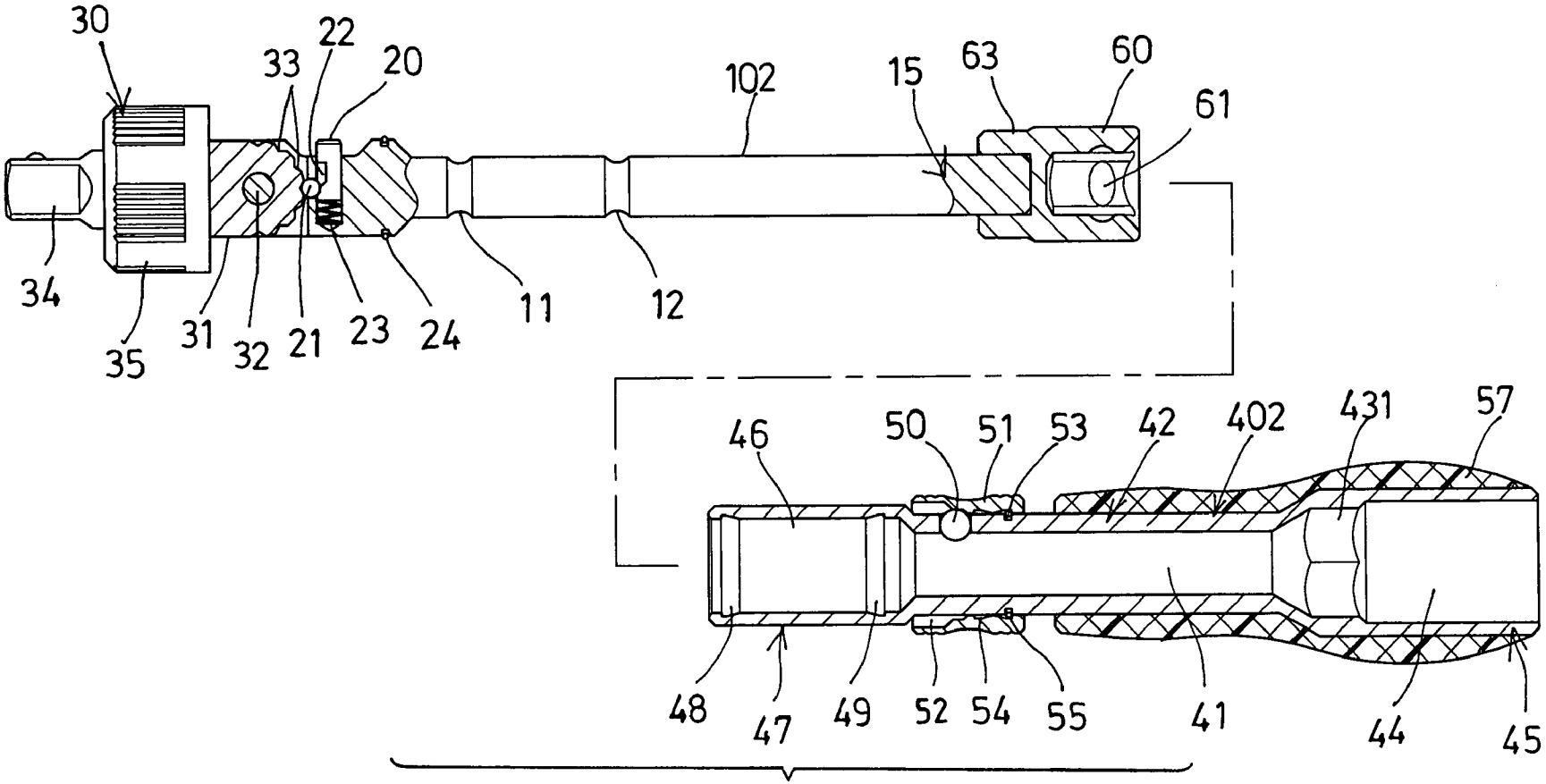
FIG. 7 is a further partial exploded and partial cross sectional view similar to FIGS. 1 and 4, illustrating the further arrangement of the tool combination.
Figure 8:
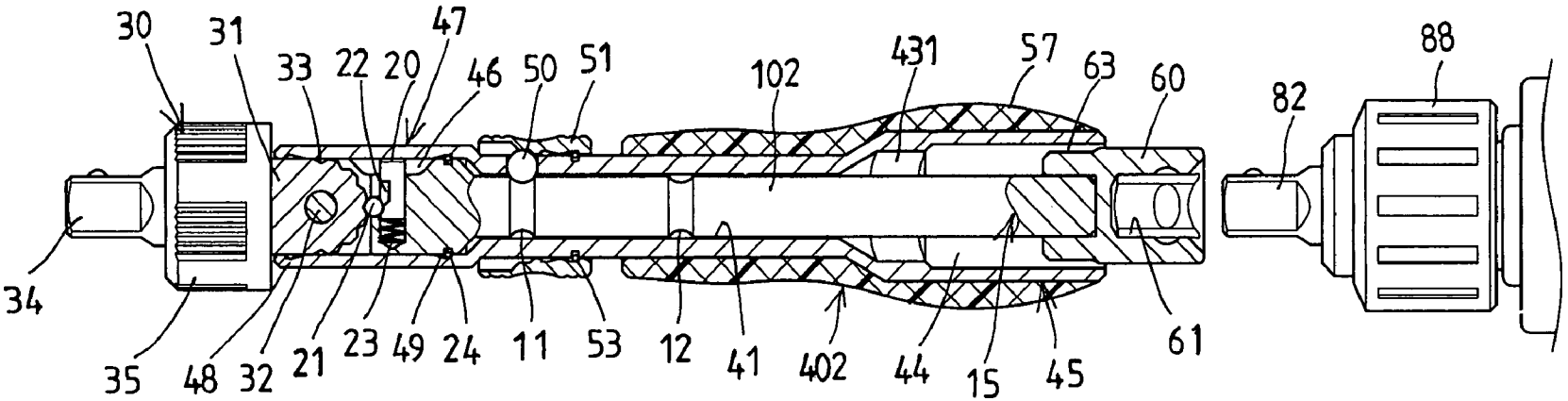
FIGS. 8, 9 are partial cross sectional views illustrating the operation of the tool combination as shown in FIG. 7.
Figure 9:
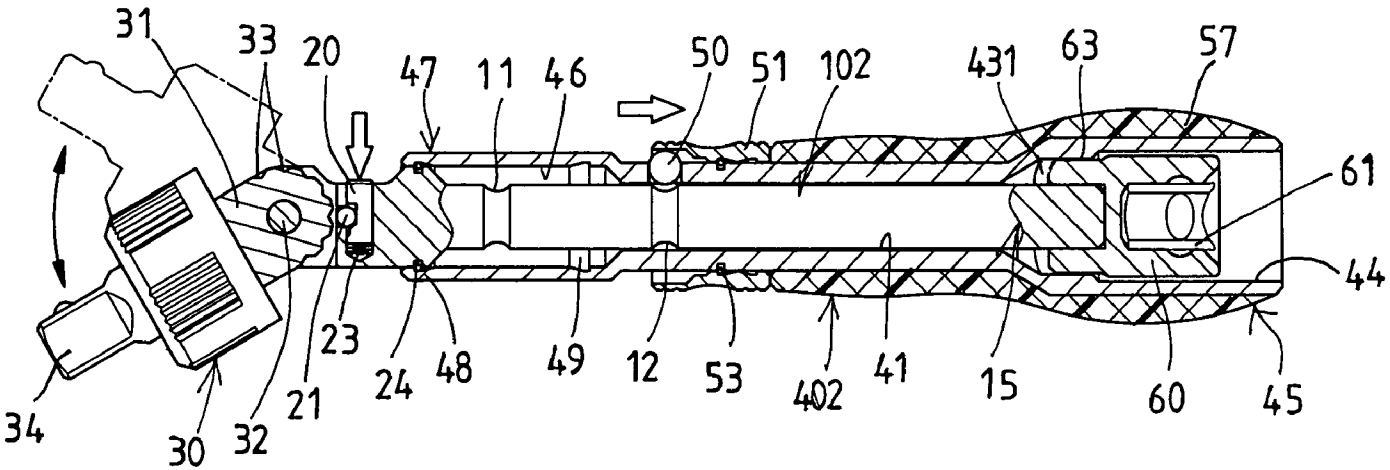

Further alternatively, as shown in FIGS. 7-9, the shaft 102 includes a socket or coupler 60 provided or attached to the one end portion 15 thereof, and the coupler 60 includes a non-circular engaging hole 61 formed therein for selectively engaging with the driving shank 82 of the power driving tool 88 (FIG. 8) and for allowing the shaft 102 to be selectively rotated or driven by the power driving tool 88 automatically, the coupler 60 further includes a non-circular portion 63 formed or provided thereon. The sleeve 402 includes a non-circular space 431 formed in the middle portion 42 of the sleeve 402 for selectively receiving or engaging with the non-circular portion 63 of the coupler 60 (FIG. 9) and for allowing the coupler 60 and the shaft 102 to be selectively rotated or driven by the sleeve 402 manually.

It is to be noted that the typical ratchet wrench tools or screwdriver tools failed to provide a shaft 10 having one end 15 extendible out of an outer sleeve 40 for selectively engaging with the power driving tool 8 and for being rotated or driven by the power driving tool 8 automatically, and simultaneously, the shaft 10 is engageable with or into the sleeve 40 and includes a non-circular stem 14 formed or provided on one end portion 15 thereof for selectively engaging with the non-circular space 43 of the sleeve 40 and for allowing the shaft 10 to be selectively rotated or driven by the sleeve 40 manually.

Accordingly, the tool combination in accordance with the present invention includes a pivotal head selectively rotatable or drivable with a power driving tool or selectively rotatable or drivable manually.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a shaft including a first end portion, and including a second end portion, and said shaft including a non-circular segment formed therein, a tool carrying head including a stud pivotally mounted to said second end portion of said shaft, and a sleeve slidably and rotatably and selectively engaging onto said shaft, and including a first end portion having a compartment formed therein for slidably and rotatably receiving said second end portion of said shaft and said stud of said tool carrying head and for retaining said stud of said tool carrying head in line with said shaft, and said sleeve including a second end portion, and said sleeve including a non-circular space formed therein, said first end portion of said shaft being engageable with a power driving tool for being selectively rotated and driven by the power driving tool, and said non-circular segment of said shaft being engageable with said non-circular space of said sleeve for allowing said shaft to be selectively rotated and driven by said sleeve, and shaft being rotatable relative to said sleeve when said non-circular segment of said shaft is disengaged from said non-circular space of said sleeve.

2. The tool combination as claimed in claim 1, wherein said shaft includes at least one peripheral recess formed therein, and said sleeve includes a detent slidably attached to said sleeve for selectively engaging with said at least one peripheral recess of said shaft and for securing said sleeve to said shaft at a selected position.

3. The tool combination as claimed in claim 2, wherein a control ferrule is attached onto said sleeve and engageable with said detent for forcing said detent to engage with said at least one peripheral recess of said shaft.

4. The tool combination as claimed in claim 3, wherein said sleeve includes a retaining ring attached thereon, and said control ferrule includes at least one ratchet groove formed therein for selectively engaging with said retaining ring and for anchoring said control ferrule to said sleeve.

5. The tool combination as claimed in claim 1, wherein said shaft includes a retaining ring attached thereon, and said sleeve includes at least one ratchet groove formed therein for selectively engaging with said retaining ring and for anchoring said sleeve to said shaft.

6. The tool combination as claimed in claim 1, wherein said tool carrying head includes a plurality of depressions formed in said stud, and said shaft includes a detent slidably attached to said shaft for selectively engaging with either of said depressions of said stud of said tool carrying head.

7. The tool combination as claimed in claim 6, wherein said shaft includes a latch slidably attached to said shaft for selectively engaging with said detent and for forcing said detent to engage with either of said depressions of said stud of said tool carrying head.

8. The tool combination as claimed in claim 7, wherein said latch includes a recess formed therein for selectively receiving said detent and for allowing said detent to be disengaged from said stud of said tool carrying head.

9. The tool combination as claimed in claim 1, wherein said tool carrying head includes a driving shank provided thereon.

10. The tool combination as claimed in claim 9, wherein said driving shank is coupled to said stud of said tool carrying head with a ratchet device.

11. The tool combination as claimed in claim 1, wherein said shaft includes a spring-biased projection engaged in said non-circular segment of said shaft for engaging with said non-circular space of said sleeve.

12. The tool combination as claimed in claim 1, wherein said shaft includes a non-circular stem provided on said first end portion of said shaft and extendible out of said sleeve and engageable with said power driving tool.

13. The tool combination as claimed in claim 1, wherein said sleeve includes a hand grip provided on said second end portion of said sleeve for being grasped and held by a user.

14. The tool combination as claimed in claim 1, wherein said sleeve includes an enlarged space formed in said second end portion of said sleeve for selectively receiving and engaging with said non-circular segment of said shaft.

15. The tool combination as claimed in claim 14, wherein said sleeve includes a lid attached to said second end portion of said sleeve for partially blocking said enlarged space of said sleeve.

* * * * *